US009952024B2

(12) United States Patent
Sullivan et al.

(10) Patent No.: US 9,952,024 B2
(45) Date of Patent: Apr. 24, 2018

(54) AMMUNITION CARTRIDGE WITH INDUCED INSTABILITY AT A PRE-SET RANGE

(71) Applicant: NOSTROMO, LLC, Alexandria, VA (US)

(72) Inventors: Kevin Michael Sullivan, Kennebunk, ME (US); Marcelo Edgardo Martinez, Cordoba (AR); Nicolas Horacio Bruno, Cordoba (AR); Roy Kelly, Alexandria, VA (US)

(73) Assignee: NOSTROMO HOLDINGS, LLC, Alexandria, VA (US)

( * ) Notice: Subject to any disclaimer, the term of this patent is extended or adjusted under 35 U.S.C. 154(b) by 190 days.

(21) Appl. No.: 14/642,818

(22) Filed: Mar. 10, 2015

(65) Prior Publication Data

US 2016/0258726 A1 Sep. 8, 2016

Related U.S. Application Data

(60) Provisional application No. 61/950,270, filed on Mar. 10, 2014.

(51) Int. Cl.
*F42B 12/40* (2006.01)
*F42B 12/50* (2006.01)
(Continued)

(52) U.S. Cl.
CPC ..... *F42B 8/02* (2013.01); *F42B 10/48* (2013.01)

(58) Field of Classification Search
CPC ..... F42B 12/40; F42B 12/50; H02M 7/48; C03B 2201/08; C03B 2201/28
(Continued)

(56) References Cited

U.S. PATENT DOCUMENTS 3,460,478 A 8/1969 Ormanns
3,528,662 A * 9/1970 Engle ..... F42B 12/362 473/577
(Continued)

FOREIGN PATENT DOCUMENTS

DE 2155467 11/1971
DE 202012010484 U1 10/2012
(Continued)

OTHER PUBLICATIONS

Engineering Design Handbook; Liquid Filled Projectile Design (Headquarters, U.S. Army Material Command, Apr. 1969), Published by Redstone Scientific Information Center, Jul. 23, 1989 (Jul. 23, 1989), Entire Document, Especially pp. 1-1, 1-2.
(Continued)

*Primary Examiner* — Michael D David
(74) *Attorney, Agent, or Firm* — Karl F. Milde, Jr.; Eckert Seamans Cherin & Mellott, LLC

(57) ABSTRACT

A training ammunition cartridge comprises a projectile and a cartridge case with a pyrotechnic propellant. The projectile has a projectile body with at least one compartment therein forming a void and containing a material that transitions from a solid to a liquid after set-back and after exiting from a barrel of a gun. The void is of such configuration as to cause the liquid material therein to induce forces and moments that, after a period of stable ballistic flight, destabilize the projectile and shorten its flight. Alternatively, the projectile void contains a solid mass that is released to shift its position after set-back and after the projectile exits from the barrel of the gun, wherein the void is of such configuration as to cause the mass, upon shifting, to induce forces and moments that, after a period of stable ballistic flight, destabilize the projectile and shorten its flight.

11 Claims, 20 Drawing Sheets

(51) Int. Cl.
*F42B 8/02* (2006.01)
*F42B 10/48* (2006.01)

(58) Field of Classification Search
USPC ..... 102/529, 502, 367, 370, 444, 464
See application file for complete search history.

(56) References Cited

U.S. PATENT DOCUMENTS

| | | | | |
|---|---|---|---|---|
| 4,128,060 | A | 12/1978 | Gawlick et al. | |
| 4,140,061 | A | 2/1979 | Campoli | |
| 4,208,968 | A | 6/1980 | Huebsch et al. | |
| 4,241,660 | A | 12/1980 | Donovan | |
| 4,911,080 | A | 3/1990 | Leeker et al. | |
| 5,001,986 | A | 3/1991 | Meister | |
| 5,153,369 | A | 10/1992 | Hardt et al. | |
| 5,402,729 | A * | 4/1995 | Richert | F41A 11/04 102/334 |
| 5,671,559 | A * | 9/1997 | Ludaesher | F41H 9/10 222/79 |
| 5,965,839 | A | 10/1999 | Vasel et al. | |
| 6,393,992 | B1 | 5/2002 | Vasel et al. | |
| 6,543,365 | B1 * | 4/2003 | Vasel | F41B 11/57 102/367 |
| 9,200,877 | B1 * | 12/2015 | Rubin | F42B 12/36 |
| 2004/0089186 | A1 | 5/2004 | Brygdes-Price | |
| 2005/0016412 | A1 | 1/2005 | Vasel et al. | |
| 2012/0175456 | A1 | 7/2012 | Hultman | |

FOREIGN PATENT DOCUMENTS

| | | | |
|---|---|---|---|
| EP | 0036232 | A1 | 3/1981 |
| EP | 0676613 | A1 | 3/1995 |

OTHER PUBLICATIONS

U.S. Army Material Command (AMC) Pamphlet No. 706-165, published in Apr. 1969.
European Office Action dated Oct. 27, 2017 from Corresponding EP Application No. EP 15 800 253.5.

* cited by examiner

DEPICTS A SIMPLE THERMAL MODEL OF A PROJECTILE TRAVELING IN A BARREL WHERE $Q_1$ IS THE NET HEAT FLOW FROM CONVECTION PROPELLANTS AND $Q_2$ IS THE NET FRICTION HEAT FLOW FROM INTERACTION WITH THE BARREL AND $Q_3$ IS THE NET HEAT FLOW FROM AIR FRICTION DURING FLIGHT.

DEPICTS A CYLINDRICAL VOID GEOMETRY IN A PROJECTILE.

ILLUSTRATES A SYMMETRIC CAVITY WHERE A (HIGH DENSITY) SOLID CYLINDRICAL MASS SUSPENDED IN A (LOW DENSITY) LIQUID SHIFTS OFF THE CENTER OF AXIS THEREBY ACCENTUATING YAW AMPLITUDE AND FLIGHT INSTABILITY.

TWO LIQUIDS INDUCE DIFFERENT TORQUES ABOUT THE CG & AXIS OF SYMMETRY

AMMUNITION CARTRIDGE WITH INDUCED INSTABILITY AT A PRE-SET RANGE

CROSS-REFERENCE TO RELATED APPLICATION

This application claims priority from Provisional Application No. 61/950,270, filed Mar. 10, 2015, entitled "AMMUNITION WITH INDUCED INSTABILITY AT A PRE-SET RANGE."

BACKGROUND OF THE INVENTION

Urbanization surrounding military training areas worldwide is changing the context and parameters of military training and the military utilization of land set aside for training. The United States and NATO militaries, when deploying, set up training areas. Due to the danger of ricochet and other anomalies, military forces are required to establish "Surface Danger Zones" (SDZs) adjacent military training ranges. The necessity to establish buffers alongside firing ranges requires militaries, or their host nations, to lease, purchase or otherwise acquire large tracks of land and erect warning signs and restrict traffic in these training areas. The maximum range of a projectile determines the size of the area to be set aside as a Surface Danger Zone (SDZ). The Surface Danger Zones (SDZs) are calculated based on the maximum range of the ammunition type(s) used in training along with a myriad of other considerations that include the ricochet danger inherent in the ammunition design. In many cases, militaries also desire to convert existing ranges from one ammunition type to another (for example to re-purpose 0.50 cal ranges to allow for live fire training on medium caliber 25 mm ammunition). In this context, "Short Range Training Projectiles" (SRTP's), also known as "Short Range Training Ammunition" (SRTA), provide both direct and indirect benefits to militaries.

The following U.S. patents disclose different types of Short Range Training Projectiles (SRTPs): U.S. Pat. No. 4,128,060 to Gawlick; U.S. Pat. No. 4,140,061 to Campoli; U.S. Pat. No. 4,911,080 to Leeker and U.S. Pat. No. 5,001,986 to Meister. All of these patents describe methods for modifying air-flow over the projectile body, thereby shortening the projectile's flight path. In addition, European Patent Pub. No. 0,036,232 A1 to DeBrant discloses designs for SRTPs where the outer surface undergoes changes after set-back that induce an aero-ballistic drag that shortens the flight path of the ammunition.

Most of these disclosed methodologies induce a linear increase in aero-ballistic drag and yaw after barrel exit. The introduction of linear aerodynamic forces will increase the drag and reduce the rate of spin of the projectile. In many cases, currently available SRTPs rely on the customer accepting a very loose or inexact ballistic match definition. SRTP designs, as advertised by GDOTS (Canada), CBC (Brazil) and NAMMO (Scandinavia), have external de-spinning features on the ammunition's outer surface where the ammunition induces an immediate reduction in spin and increased drag after barrel exit. The requirement to utilize de-spinning features where the projectile's outer-diameter is modified can, in certain calibers, negatively affect ammunition feeding.

SUMMARY OF THE INVENTION

A principal objective of the present invention, therefore, is to provide a training ammunition cartridge where the flight path of its projectile initially matches the flight path of a reference projectile and subsequently loses stable flight characteristics, thus shortening the maximum range of the projectile. The shortened maximum range can reduce the Surface Danger Zone both at the end and aside of the firing range.

This objective, as well as other objectives which will become apparent from the discussion that follows, are achieved, in accordance with the present invention, by an ammunition cartridge with a projectile:

(a) with a void, and (b) a liquid contained in the void (which may be coupled with a solid mass that shifts) which, after barrel exit, acts on a projectile body and induces further, additional forces on the projectile that, after a period of stable ballistic flight, destabilize the projectile's flight and shortens its flight.

Advantageously, the projectiles according to the invention are designed to initially exhibit a very close match to reference (e.g. ball) war-shot ammunition but, at a point in the training projectile's ballistic path, the liquid and, if present, the solid material in the void induces a combination of forces that quickly destabilize the projectiles' flight.

The shortening of the maximum range of the projectiles allows for a corresponding reduction in the surface danger zone surrounding a firing range. Militaries and owners of private ranges can therefore use larger caliber ammunition on ranges originally developed for small caliber ammunition.

Alternatively, the SRTP's according to the present invention allow militaries and/or private range owners to establish training ranges on smaller parcels of land. This, in turn, allows militaries to convert land previously set aside for surface danger zones to re-utilize, and/or repurpose the land set aside for small caliber shooting to train with larger weapons.

Solid-Liquid Mass Ratio:

In cases where the amount of solid mass is significantly greater than a projectile's liquid mass, the mathematical calculations regarding stability and instability are greatly simplified. The AMC Pamphlet pp. 70-165 states:

> "For a heavy projectile filled with a comparatively small mass of liquid, the stability of problems reduces the problem of calculating the Eigen frequencies (of the liquid) and associated residues."

Using a high solid-to-liquid ratio allows a designer to harvest the heat and select a fusible material that, when liquefied and heated, reaches a viscosity where the Eigenvalue immediately induces flight instability. The AMC Pamphlet pp. 706-165 states:

> "It was shown again that resonance between the natural frequencies of fluid and the projectile is the cause of the dynamic instability of the projectile containing such liquid filled cavities."

For a complete understanding of the invention, it is important to know that the void geometry of the SRTA projectile induces forces on the projectile accentuating spin decay and yaw. It is also possible to configure the geometry to shift the center of gravity of the projectile to further accentuate the projectile's yaw amplitude and frequency, thereby further degrading the flight stability. The selection of the void geometry identifies what design equations to utilize in predicting both stable flight and the projectile's transition to unstable flight.

Liquids in a Void:

It is known that liquids generally exhibit nine hundred times more resistance to motion when compared to that of a gas. Liquids may also exhibit a resonance that can influence objects in flight. Prior work has shown that configurations with of a projectile's liquid filled void often had an infinite set of initial boundary conditions and projectiles have frequently been troublesomely susceptible to picking up resonances which have imparted un-predictable forces that act on the projectile in flight.

Early designers of liquid fuel rockets went to extensive efforts to understand and manage the complicated characteristics exhibited by liquid fuels in the rockets in flight.

Like a spinning top, a projectile's gyroscopic stability is achieved by optimizing the mass rotating around center of gravity and the axis of rotation. Thus in combination with other parameters cited in this reference, a designer can, in selecting materials and geometry, shift the solid mass in a projectile to further reduce a training projectile's gyroscopic stability, further shortening its range.

The U.S. Army Material Command (AMC) Pamphlet 706-165, published in April 1969 and approved for release to the public in January 1972, provides an authoritative overview of the challenges associated with designing liquid filled projectiles. The opening paragraph states "the problem of the unpredictable behavior of liquid-filled projectiles in flight has been known to designers for a long time." This AMC Pamphlet was published to assist Army ammunition designers in producing ammunition with payloads such as white phosphorus that, under certain conditions, could liquefy and create flight instability. The AMC Pamphlet 706-165 further notes the challenge in establishing repeatable initial boundary conditions for a projectile containing a liquid. The pamphlet notes that "spin up" of the projectile in the barrel after set-back and before barrel exit often produces severe transient instability that renders a liquid-filled projectile useless in practice and can, further, render Stewartson's equations irrelevant. The feeding and handling of a projectile and its subsequent chambering in a breach creates an almost infinite set of initial boundary conditions making it almost impossible to establish a design that produces repeatable performance at barrel exit. Spin-stabilized ammunition that is fired with a liquid material retains transient spin instabilities that vastly complicate a designer's ability to reliably induce derogation of flight ballistics.

The "Miles Report on the Stability of Liquid Filled Shells" (1940) identified the basic physics for stable and unstable projectiles in flight. This mathematical formulae coupled with Miles' experimental data show that projectiles with a specified range of features were stable in flight while other projectiles were unstable. Thus it was shown that, when using a certain set of parameters, it was possible to have a stable liquid filled projectile. Thus, using the so-called "Miles" equation, a projectile can be configured to initially exhibit stable flight and, by introducing and manipulating post set-back conditions a designer can destabilize the projectile's flight. One should note that the formulae derived in the Miles report shows that liquid-filled projectiles generally exhibit either an increasing or diminishing yaw amplitude. Alternatively, it is possible to insert a material that liquefies after set-back and, in accordance with Miles formulae, produces an inherently unstable flight. By fixing the initial boundary conditions (e.g. of the material that acts as a solid until muzzle exit), the projectile exits the muzzle with six degrees of flight freedom acting as a solid.

The present invention allows a designer (1) to use the Miles equation to identify a liquid-filled projectile that will initially have stable flight and where forces in the projectile subsequently destabilize the flight, or (2) to firmly establish the initial boundary conditions of barrel exit by using a material that transitions from solid to liquid after set-back. The change from a solid to liquid may be accomplished either by a heat-induced phase change or by the use of a Non-Newtonian liquid or dilitant. In flight, the liquid in the void induces forces that destabilize the projectile's flight after an initial match period with a reference projectile.

The material contained in the void is a solid when it transits the barrel. This solid does not retain resonance frequencies as are generally induced in liquids and which are known to be detrimental when liquid-filled ammunition exits the barrel. According to the invention, however, the material rapidly liquefies after barrel exit and, interacting with the void geometry and solid projectile body, reliably increases the yaw amplitude and frequency of the projectile. This approach provides the basis for a unique design the projectile, causing it to become unstable in flight.

Eigenvalue of Selected Liquids, Resonance, Nutation and Damping

The selection of a void geometry and void liquid must be taken with care as liquids have known Eigenvalues (Eigen frequencies) that can induce increasing resonance in the projectile. Materials placed into the void will have a natural liquid frequency that, under certain conditions, will amplify resonance and forces creating instability. Thus a designer must take care that, when selecting void liquids, the materials must not induce an unwanted, destabilizing, liquid resonance during the projectiles barrel traverse when under high acceleration. While it is generally desired to preclude the introduction of unwanted resonance at spin up, during free flight it may be desirable to induce resonance or a combination of other characteristics that quickly amplify the projectile's yaw amplitude, causing the projectile to quickly lose its flight stability.

A selected liquid may induce desired or undesired instability when the Eigen frequency falls near the natural frequency of the liquid or nutation frequency. Alternatively, a selected liquid may introduce a stabilizing damping effect. Fundamentally, the selection of a liquid should allow the projectile exiting the barrel to have degrees of freedom and velocities that match the desired reference projectile.

Fluids in a Projectile's Void:

The present invention comprises a projectile containing a void and a select material contained in the void. The material is a solid or a non-Newtonian fluid at set-back that liquefies after set-back and muzzle (barrel) exit. The liquefied material initiates a combination of forces that induce instability in the projectile. The AMC Pamphlet states, "Experiments show that Stewartson's theory with viscous corrections accurately predicts the initial rate growth of amplitude at resonance." The instability is created after a short period of stable flight where the projectile flight path closely matches the path of a reference projectile. In addition to resonance, internal geometry and characteristics of the void create friction between the liquid and solid. Properly coupled together, void geometry, liquid-solid forces and imparted resonance increase a projectile's yaw amplitude and retard the projectile's rotational frequency which, in combination, destabilize the projectile.

One should note that the fluid must act as a Non-Newtonian fluid under the high g-forces of acceleration. Many materials that exhibit normal flow liquid characteristics under nominal conditions exhibit Non-Newtonian characteristics under the high-g forces induced at acceleration. Thus where resonance might be induced on normal unstressed liquids, certain liquids that exhibit Non-Newtonian characteristics' under g-loads may no longer exhibit Newtonian characteristics. Amplification of a liquid's natural frequency is precluded and risks associated with associated perturbations are eliminated and initial barrel exit conditions are normalized.

Fluids: Newtonian and Non Newtonian:

One can also utilize features inherent in certain liquids to changes stresses and moments under high acceleration prior to barrel exit and can also introduce liquids that change characteristics in flight. Rheopectic liquids become more viscous when shaken, agitated or stressed. Bingham plastics behave as a solid in low stress environments but exhibit viscosity under stressed conditions. Shear thickening liquids exhibit increasing viscosities with increased shear stress. Shear thinning liquids exhibit decreased viscosity as the shear stress is decreased. Thixotropic liquids become less viscous when shaken, agitated or otherwise stressed. Dilatant or shear thickening behavior is typically observed in fluids with a high concentration of small, solid particulate suspended within a liquid. Behaving like a true fluid under low shear stress conditions, dilatants then transition to a solid-like condition when a greater shear stress or force is applied. The greater the force (shear) applied to a dilatant material, the more resistance will be felt. When subjected to extremely high levels of shear stress under the high-g loads of acceleration, dilatant materials become very rigid.

Firing Environment and Solid-to-Liquid Transformation:

The projectile can utilize the heat imparted to its driving band as it progresses through the barrel and/or it can harvest heat from the pyrotechnic propellant, transferring the heat to the material in the void. The resulting increase in temperature flows from the driving band and the propellant through the projectile body into the void. The heated material in the void undergoes a phase change from solid to liquid. The liquefied material in the void induces forces on the projectile in flight.

In addition to the foregoing methodology of harvesting heat from the driving band and the rear of the projectile, high velocity projectiles may harvest heat in flight in the vicinity of the nose. It is well known that air friction encountered by high velocity projectiles in flight transfers significant heat into the projectile's nose assembly. Therefore, in certain configurations, in is advantageous to locate a void with a liquid in the void harvesting the friction heat to induce a phase change in the material housed in the void.

Alternatively, the void can be filled with a non-Newtonian fluid which acts as a solid when exposed to high acceleration forces but exhibits the characteristics of a normal liquid in a reduced acceleration environment. Thus, at set-back and continuing through to muzzle exit during which the projectile encounters a rapid acceleratory force, the high G-forces acting on the non-Newtonian fluid cause the fluid to act as a solid mass. At barrel exit, where the projectile is suddenly in free flight in a low G environment, the non-Newtonian material acts as a liquid. This allows the design to establish a fixed set of barrel exit conditions that closely match those of a reference projectile and subsequently induce instability that shortens the projectiles flight path. In setting repeatable boundary conditions and matching the exterior form of a ball projectile, a good initial match to a ball projectile is achieved.

Short Range Training Ammunition Design Solutions:

Through the use of various ballistic methodologies, including well-known McCoy 6DOF calculations, and adjusting the exit velocity to offset differences in projectile mass a designer can establish required barrel exit parameters that allow a close ballistic match to reference ammunition. By using cited formulae and in selecting a combination features that includes a cavity geometry coupled with:

(1) a mass ratio (liquid and solid), and liquid Eigen frequency that minimizes perturbation, (2) a material that transitions to liquid after barrel exit with optimized Eigen frequencies (to either stabilize or destabilize projectile flight), and (3) with a further option to add a shifting solid mass within the void the ammunition designer can establish a training projectile design that reliably and repeatedly (1) has a short flight trajectory where the projectile matches a reference projectile and (2) the training projectile subsequently encounters rapid spin decay and increased yaw amplitude that increases drag and reduces the projectiles range.

Trans-Sonic Transition, and Increasing Conning Motion:

After set-back, the drag from air resistance continuously reduces the projectile's velocity. When projectile's transition from super-sonic to sub-sonic flight, the air-flow around the projectile exhibits dramatic changes. The shock wave emanating from the tip of the projectile at supersonic speed moves rearward over the projectile body toward the base. The center of pressure, which stabilizes the spinning projectile about the axis of symmetry, moves forward. In these transitional circumstances, a projectile is more susceptible to flight destabilization. Thus, using the present invention, one can design a projectile that loses all flight characteristics when the projectile transitions from supersonic to sub-sonic flight.

Cavity (Void) Form and Types:

After selecting a void geometry, a solid-to-projectile mass ratio, and a liquid fill, the designer can use corresponding equations for stability and instability. Again, the selection of a material for post set-back liquefaction and the corresponding Eigenvalue of the liquid are important design criteria. Gyroscopic stability of the solid mass should be considered. Table 1 below identifies stability and instability formulas for corresponding void geometries. One may categorize voids and approaches with reference to their symmetry (or lack of symmetry) about the projectile's axis of spin. Mathematical equations that are verified by observation correspond to each approach.

TABLE 1

Void Geometry and Liquid Payload Induced Instability

| | | |
|---|---|---|
| Symmetric Cavity Axis of Spin/ Rotation | Cylindrical Cavity | Use Stewartson's Solution (note 1) |
| | Spheroid Cavity | Use Greenhill Calculations |
| Nonsymmetrical Cavity | | Use Wedemeyer's theory and Ritz Calculations. For non-symmetrical cylindrical cavities utilize Stewartson's equation. |

Note

1 Reference K. Stewartson "On the Stability of a Spinning Top Containing Liquid Fluid Mechanics" (1959)

Cylindrical Cavities:

Cylindrical cavities are useful when producing ammunition since most projectiles have a basic cylindrical form with the cylinder capped by a conical nose. Forming processes for cup-shaped forms have long been a cost effective method of metal forming in ammunition manufacture. Therefore, it is practical to produce cylindrical voids during ammunition production. Stewartson's equations, published in 1959, provided mathematical solutions to induce instability when a liquid is housed in a cylindrical cavity. The set of equations allows designers to design ammunition that induces predictable instability. Karpov's publication of "Dynamics of Liquid Filled Shell: Resonances in Modified Cylindrical Cavities" was published in 1966 and added to this body of work.

Spheroidal Cavities:

The stability and instability problem for a filled spheroidal cavity was solved by Greenhill in 1880. While cylindrical voids would generally be preferred to spheroid cavities in projectiles, the formation of spheroidal cavities can be readily introduced in production designs.

Non-Symmetric Cavities:

While the equations for non-symmetric cavities have less confirmatory experimentation, the basic formulas provide for a method to construct voids the induce forces to destabilize the projectile upon liquefaction of the void material. A non-symmetric cavity may be designed to quickly shift the center of gravity away from the axis of rotation.

Laminar and Non-Laminar (Turbulent Flow) of Liquids:

The designer can modify the internal geometry and surface of the void to induce either laminar or non-laminar flow of the liquid in the void. This flow increases liquid-to-solid friction, reducing the projectile's spin rate and increasing the instability in an SRTP.

Center of Gravity Shifts:

It is, in certain circumstances, advantageous to select material combinations and geometry that induce center of gravity shifts after a short period of free flight. Center of gravity shifts, off-center from the axis of rotation, accentuate yaw amplitude and degrade the projectile's flight stability. Suspending a dense solid in a lower density material that liquefies after set-back allows a designer the ability to shift the center of gravity of the projectile, thus inducing increased yaw.

Container and Projectile Body:

In many circumstances, it is advantageous to select materials housing the liquid and construct the projectile so that the projectile is frangible in nature. The frangibility of the selected materials will reduce the risk of ricochet and reduce the SDZ of the projectile.

Reducing Ricochet Danger:

While frangible ammunition is frequently preferred, material selection and size can preclude use of frangible projectile bodies. Ricochet dangers extend the SDZ of training ranges although it is generally desired to reduce the size of SDZ's set aside because of the risk of ricochet. Certain liquid-filled voids will align the rotation of liquid and solid spin along the same axis. Where a ricochet occurs, the projectile's solid body will deflect and continue its flight. The disclosed configuration, with an initially aligned liquid and solid axis of rotation where, after deflection, the changed axis of solid rotation and the liquids in the void exert forces on the projectile that rapidly degrade and shorten the deflected projectiles flight path.

For a full understanding of the present invention, reference should now be made to the following detailed description of the preferred embodiments of the invention as illustrated in the accompanying drawings.

BRIEF DESCRIPTION OF THE DRAWINGS

FIGS. 5*a* and 5*b*, respectively, are graphs of residual velocity vs. range for such a projectile.

DETAILED DESCRIPTION OF PREFERRED EMBODIMENTS

Figure 1:
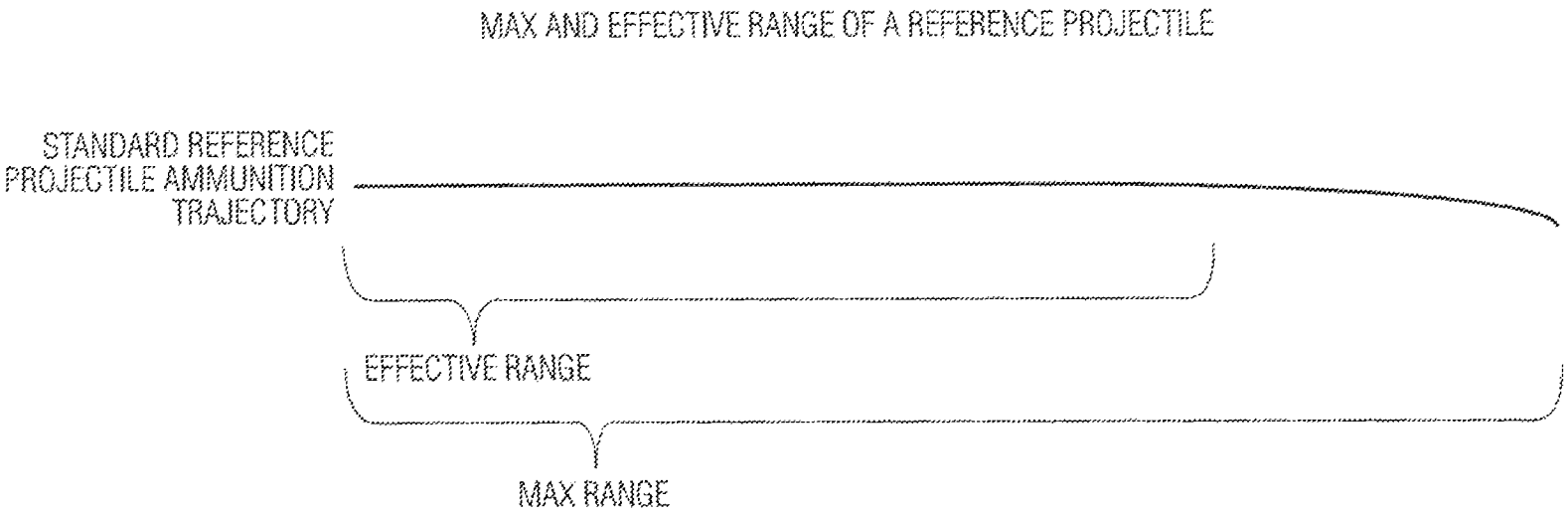
FIG. 1 illustrates a typical ammunition projectile trajectory having an effective range and a maximum range.

The preferred embodiments of the present invention will now be described with reference to FIGS. 1-20 of the drawings. Identical elements in the various figures are designated with the same reference numerals.

Embodiments of the present invention provide for a projectile that has an excellent ballistic match (flight path) with respect to reference ammunition for the initial stage of free flight. After a set period of transit, a liquefied material in the SRTPs void imparts forces on the projectile that rapidly degrade the SRTP's flight characteristics thus shortening the projectile's maximum range.

FIG. 1 illustrates the effective range of a reference projectile and the maximum range of this projectile.

Figure 2:
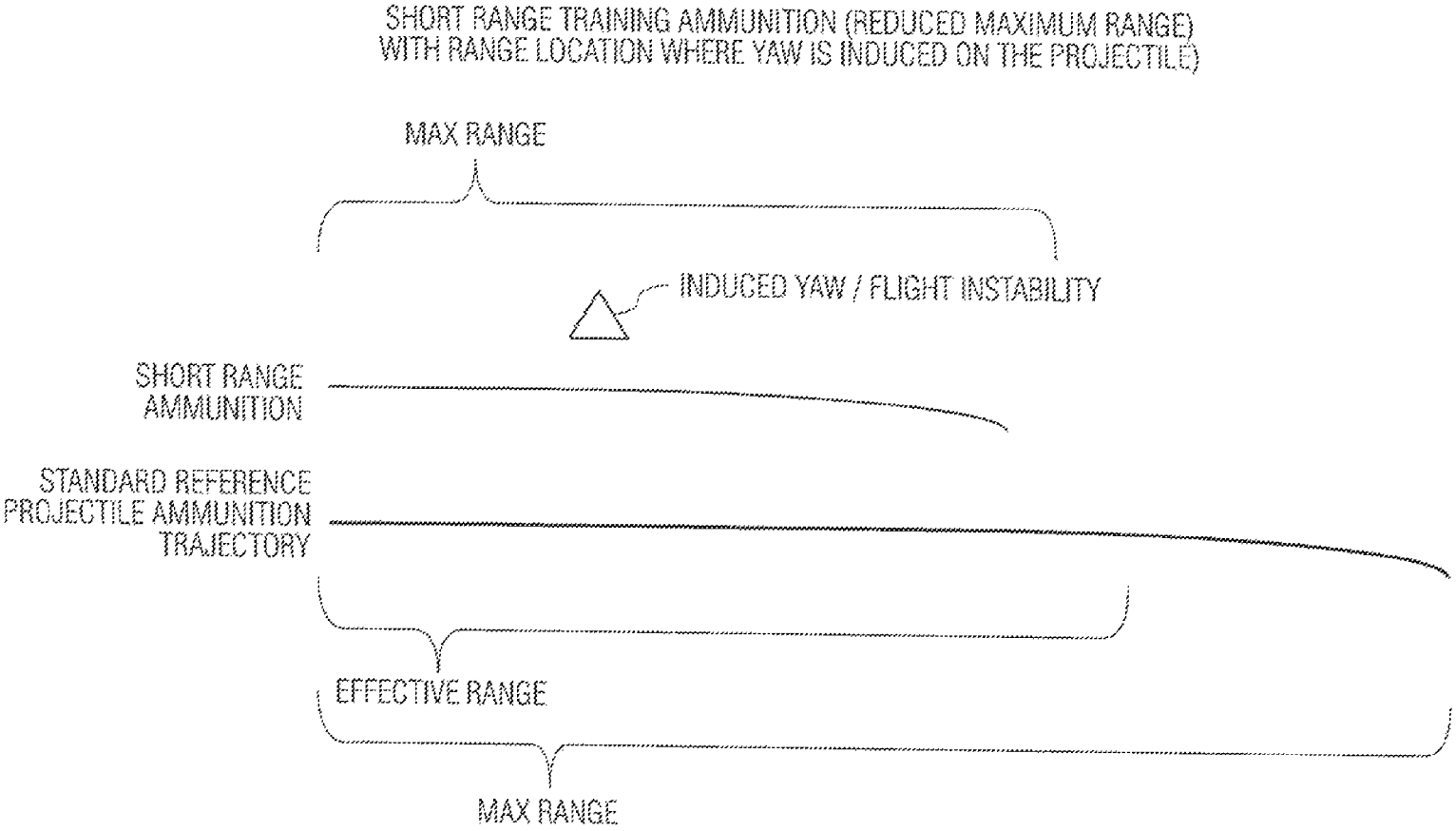
FIG. 2 illustrates a Short range Training Projectile (SRTP) trajectory where forces imparted on the projectile have shortened the maximum range of this ammunition.
Figure 3:
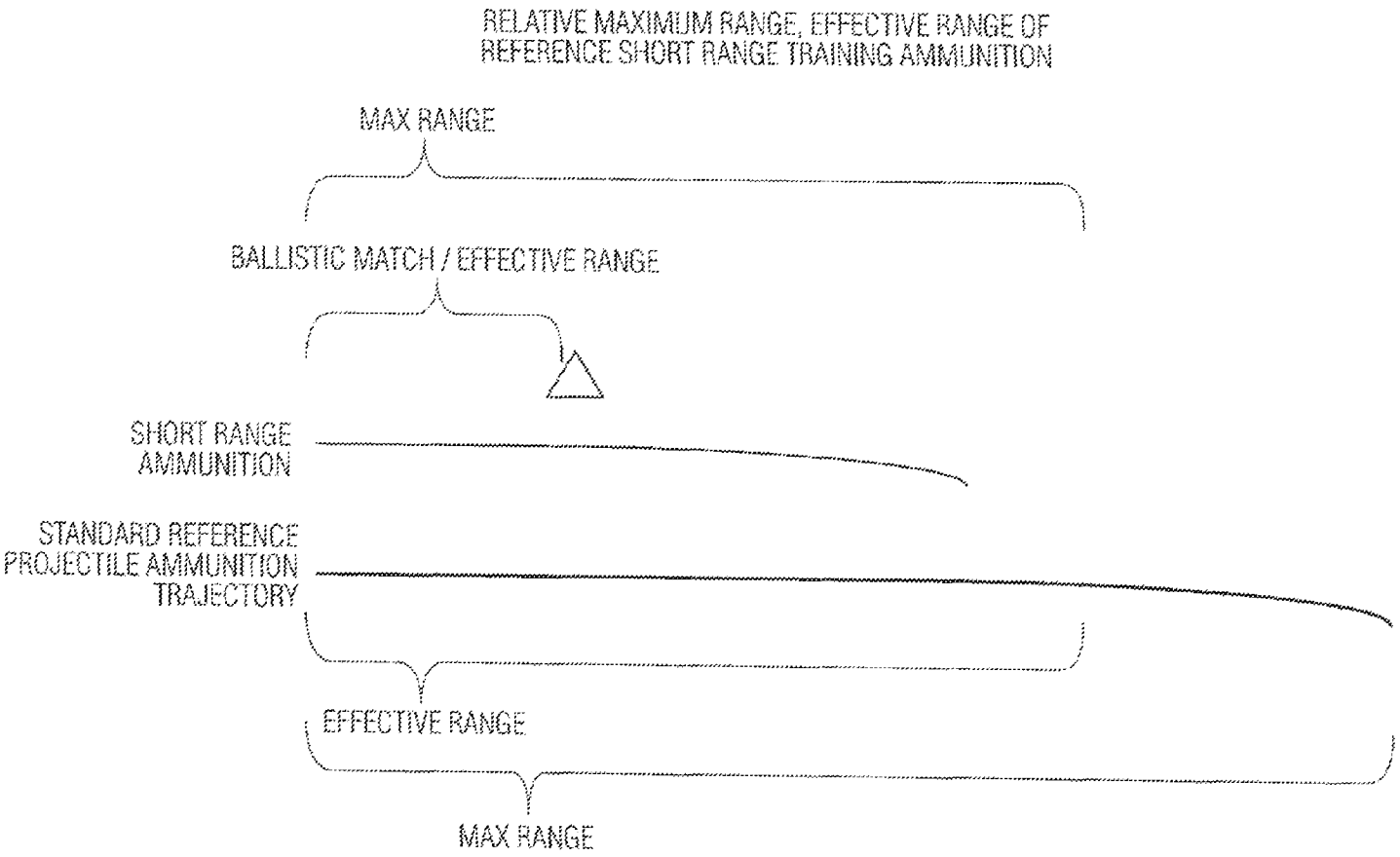
FIG. 3 illustrates the distance where an SRTP will match the flight profile of reference ammunition which may be a ball or war-shot ammunition.

FIG. 2 illustrates a location along a flight path where instability is induced, shortening the maximum range of a projectile. FIG. 3 further illustrates the resulting ballistic match distance where a SRTP matches a reference ammunition.

Figure 4:
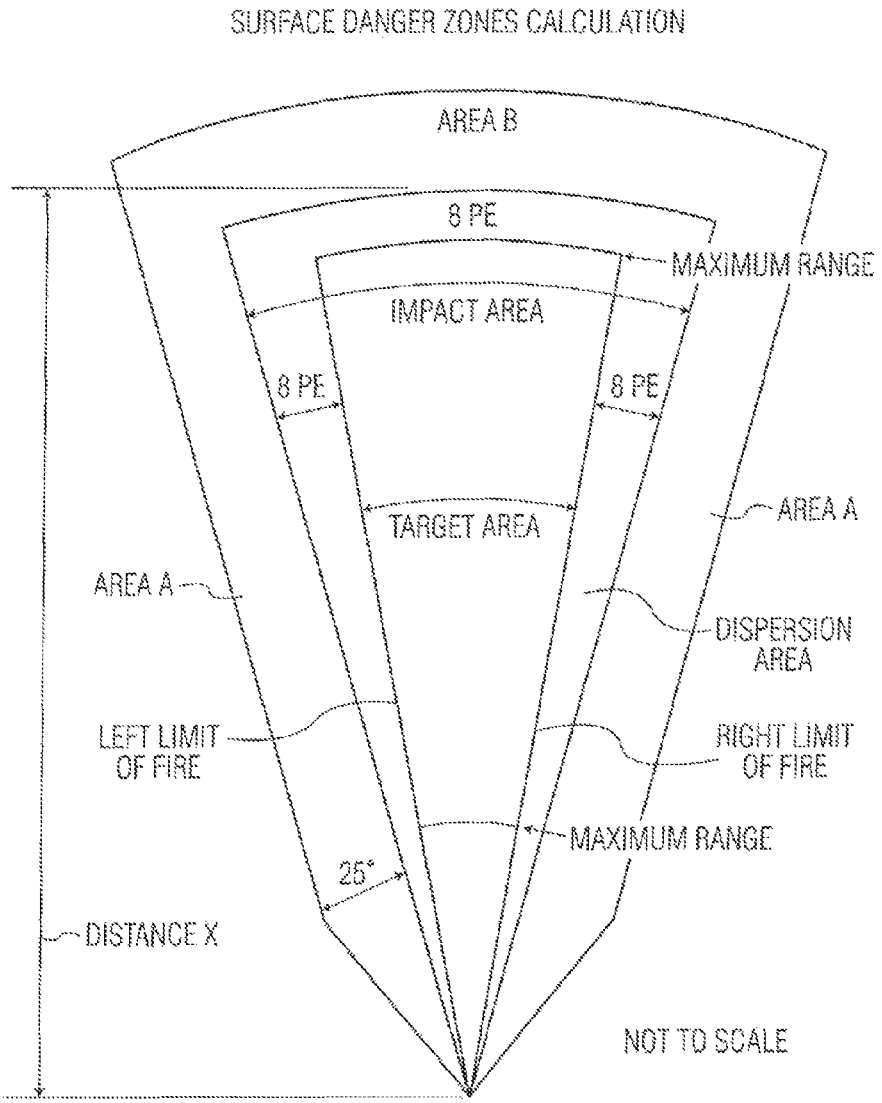
FIG. 4 is a safety diagram extracted from the US Army FM 23-91, Appendix B, illustrating the methodology for calculating a Surface Danger Zone (SDZ) surrounding the impact area of a military training range.

FIG. 4 illustrates how Surface Danger Zones (SDZs) are calculated, requiring military and range owners to set aside land adjacent ranges to prevent personal injury or death. The SDZs are extended beyond the range of the ammunition to provide for an additional buffer due to ricochet danger, and metrological and geodesic factors that extend the possible flight path of ammunition in certain circumstances. A reduction in the maximum range of a projectile has a corresponding reduction in the required SDZ that must be established surrounding a range.

Figure 5:
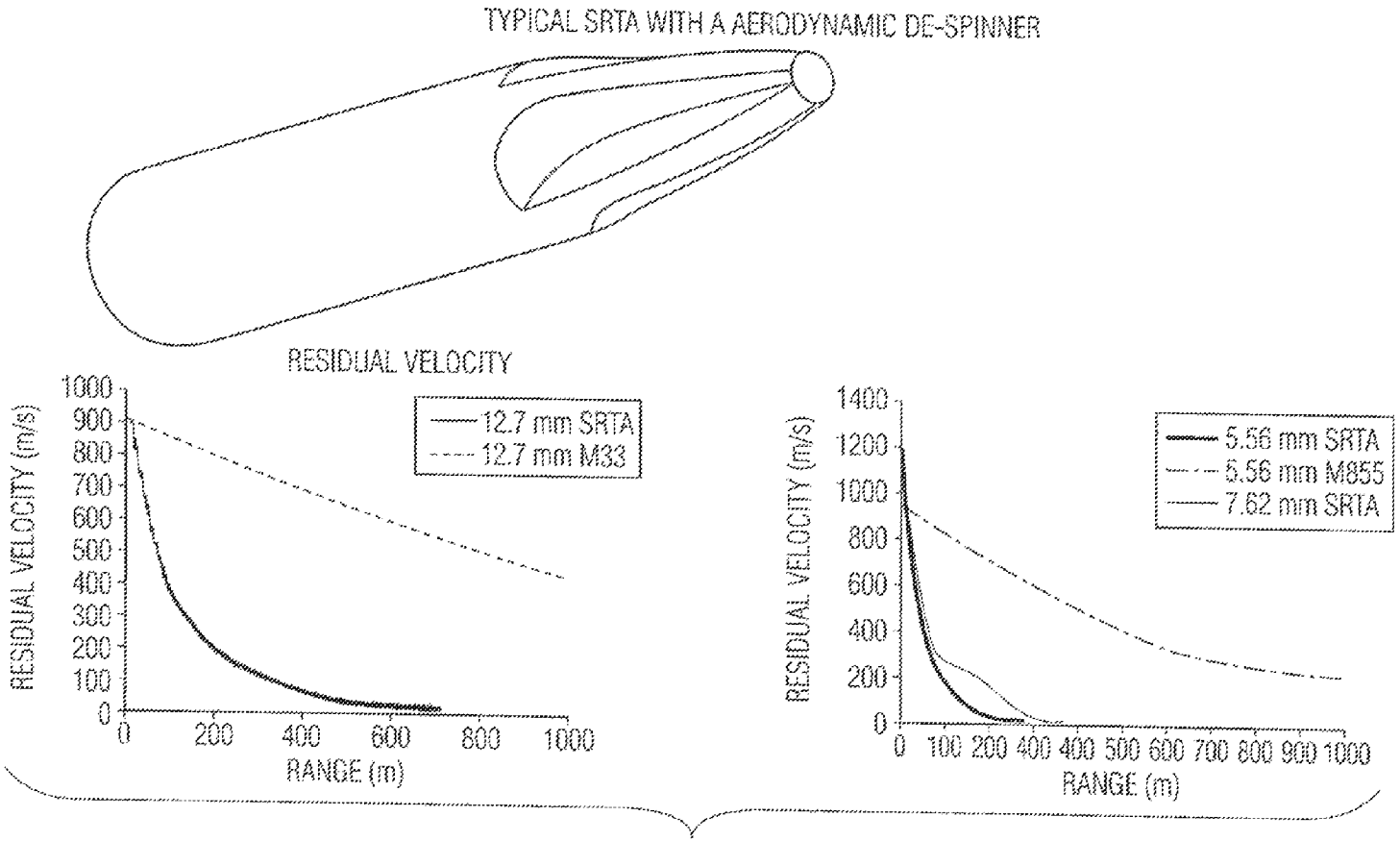
FIG. 5 shows a typical aerodynamic de-spinner projectile which is currently the prevailing approach to the design of SRTPs.

FIG. 5 depicts a known aero ballistic de-spinning projectile, together with publically released performance data. This approach is the current prevailing technical approach to produce small caliber Short Range Training Ammunition (SRTA). This approach requires the manufacturer to carve or form a de-spin vane on the nose of the projectile. In some larger caliber weapons, where ammunition feeding mechanisms are guided by the nose of projectile, the vanes may interfere with weapon function. Moreover, there are basic aerodynamic limitations to this approach. The approach also mediately effects the flight of the projectile requiring a user to accept a loose definition of a ballistic match.

Figure 6:
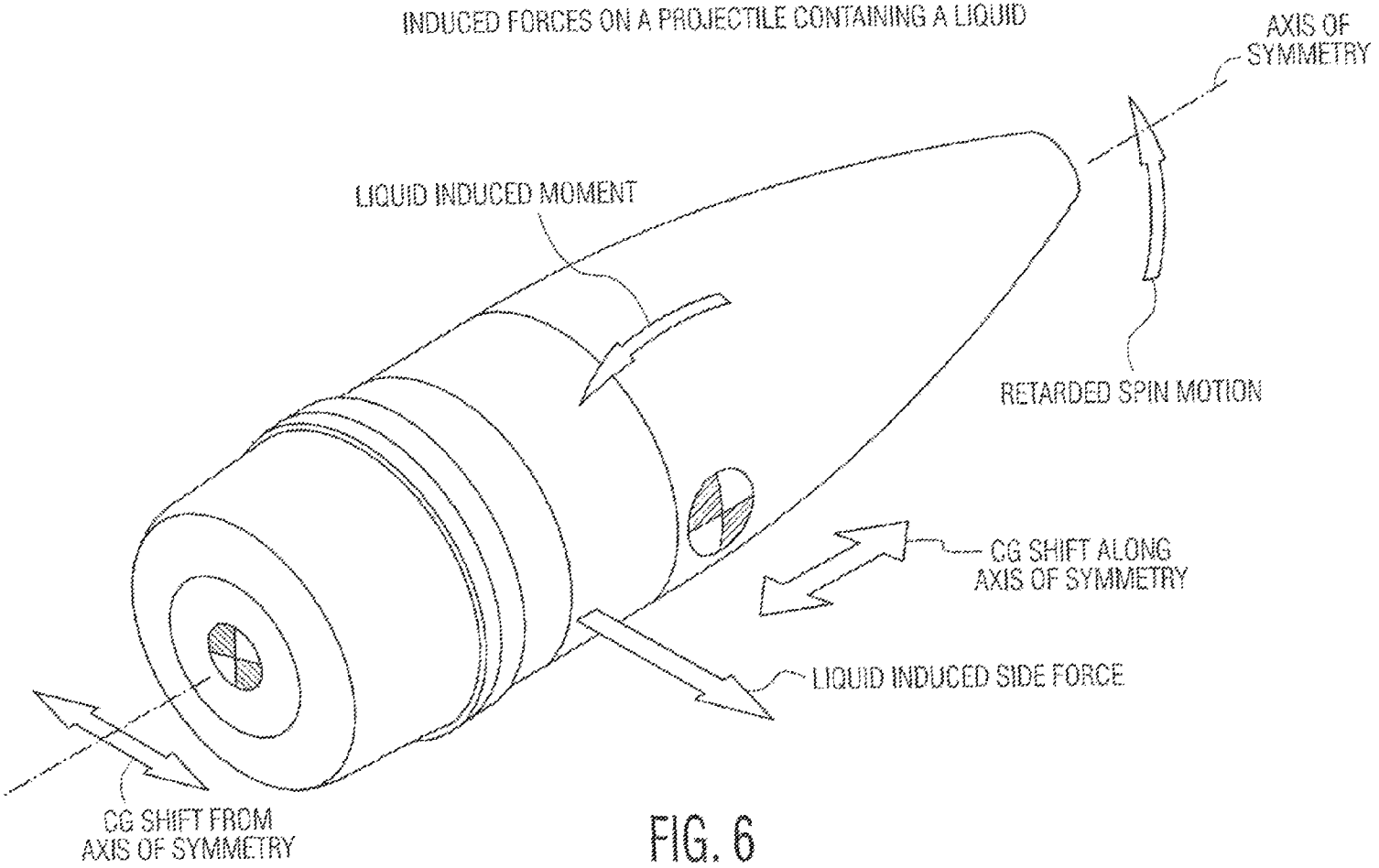
FIG. 6 illustrates the forces induced on a projectile by a liquid housed in a void while the projectile is in free flight. The effect of liquid resonance is not depicted.

FIG. 6 depicts the forces induced on a projectile with a liquid fill. According to the invention a projectile designer may adjust these forces to induce instability in the projectile and provide for a trajectory with a good ballistic match and, thereafter, with a quickly encountering instability, thus shortening the range.

Figure 7:
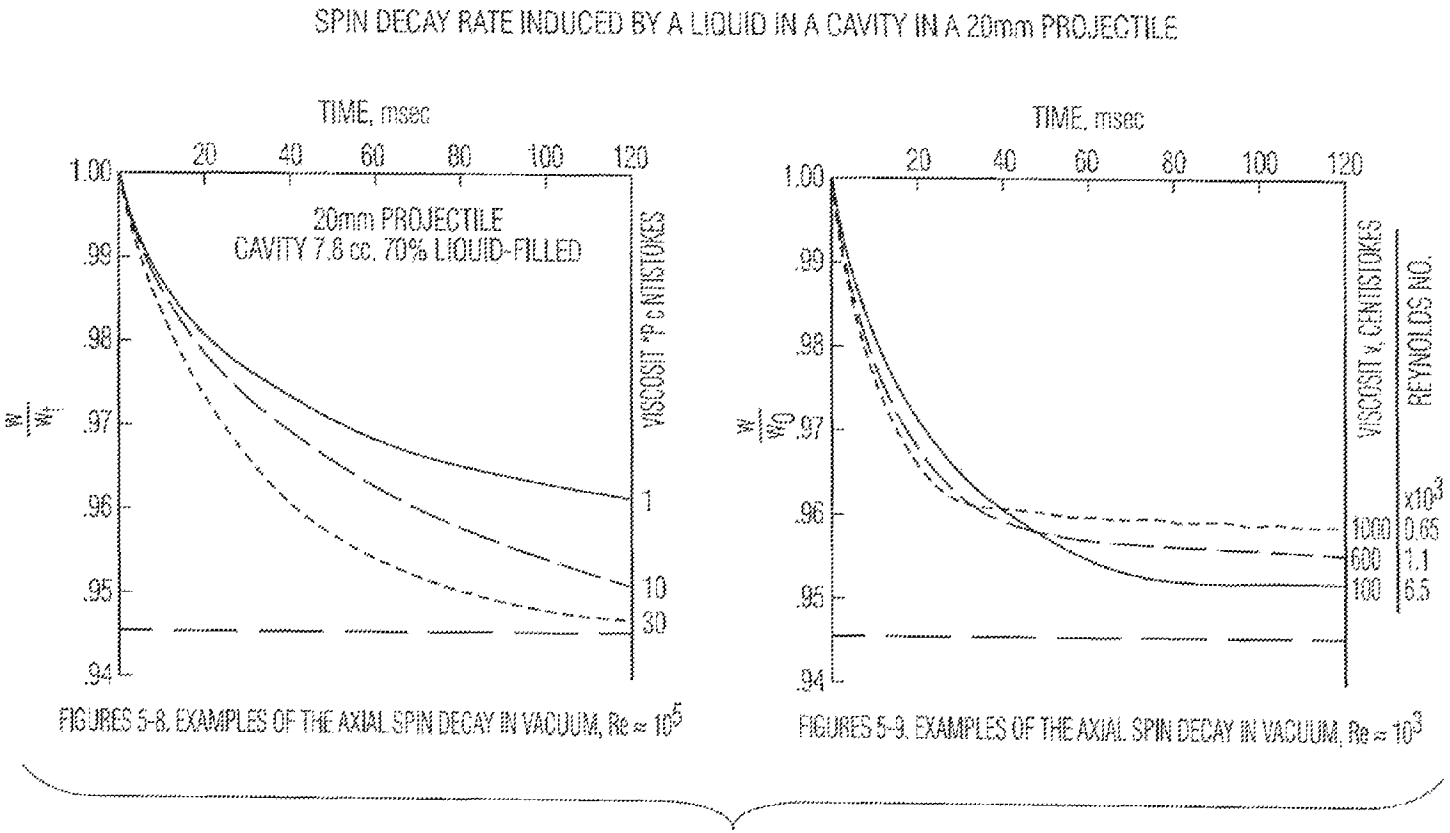
FIG. 7 is an extract from AMC Pamphlet 706-165 (Distribution A for Public Release) depicting the spin decay of a 20 mm projectile with a 70% liquid fill.

FIG. 7 depicts US Army test results showing spin decay rates induced on a 20 mm projectile containing a liquid cavity.

Figure 8:
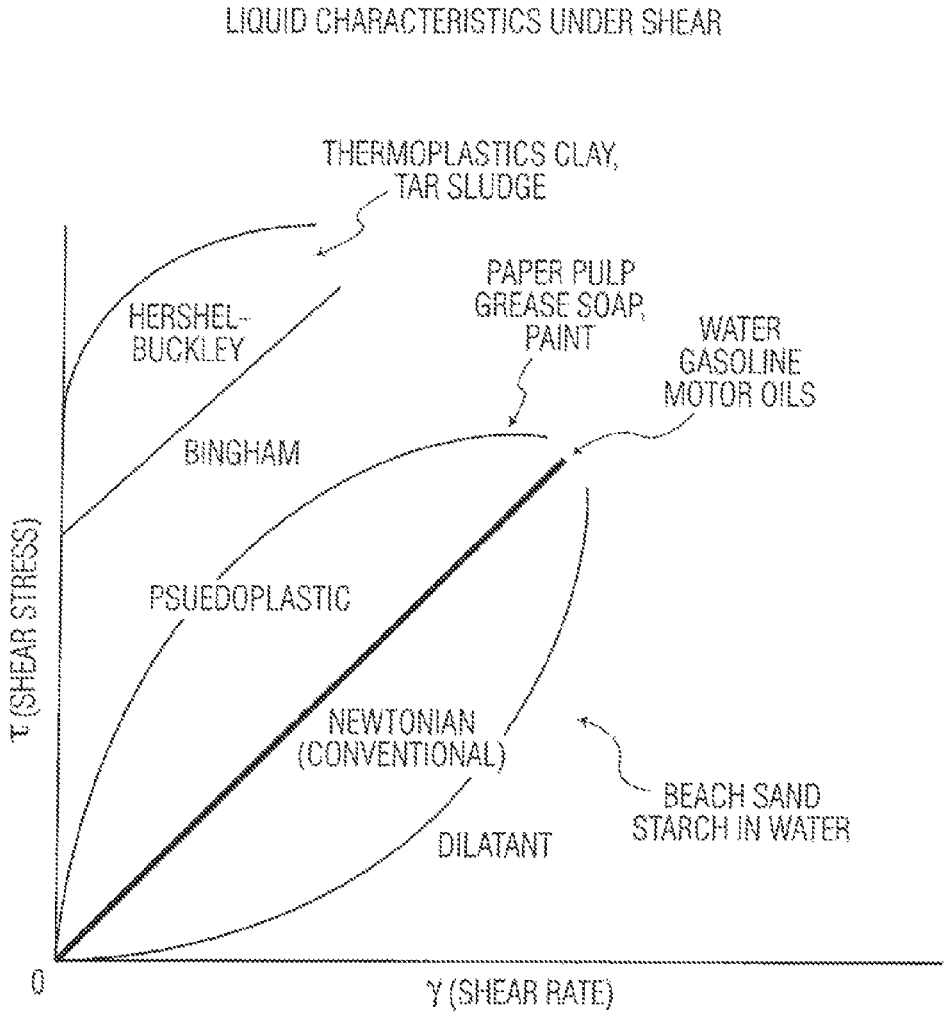
FIG. 8 depicts the liquid characteristics of various types of liquids when exposed to shear forces.

FIG. 8 depicts the sheer force effect of fluids.

Figure 9:
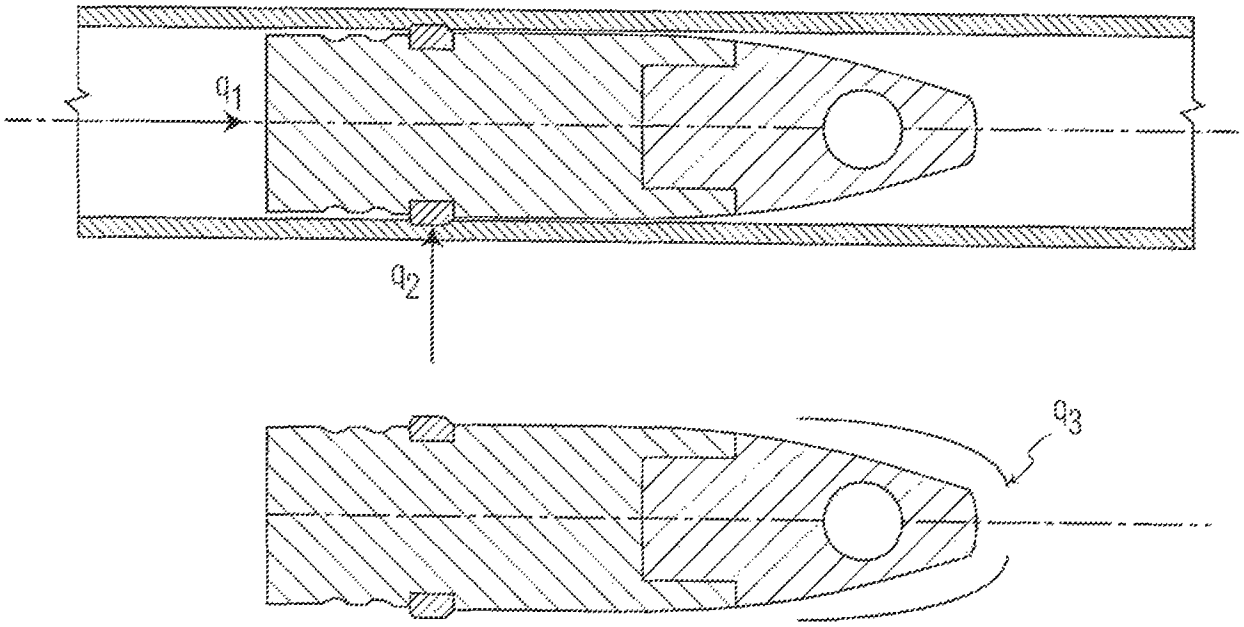
FIG. 9 depicts a projectile traversing a barrel as a simple thermal model, where friction between the barrel and the projectile's driving band, coupled with the heat of hot propellant gases, heat the projectile. The image also depicts how the friction of high velocity air-flow over the projectiles body induces heat in the projectiles nose.

FIG. 9 depicts a simple thermal model of the transfer of heat into a projectile. When traversing in a barrel, the projectile is heated by the hot, expanding propellant gases at the base of the projectile and is also heated by the mechanical friction of the driving band's engagement with the inner diameter of the barrel. Additionally, when a high velocity projectile exits the barrel and enters free flight the air-flow over the projectile's nose and outer surface generates friction forces that heat the projectile's nose cap. In all cases, the heat generated by friction passes through the projectile body, driving band and nose cap to the void to induce a solid-to-liquid change in the void material.

Figure 10:
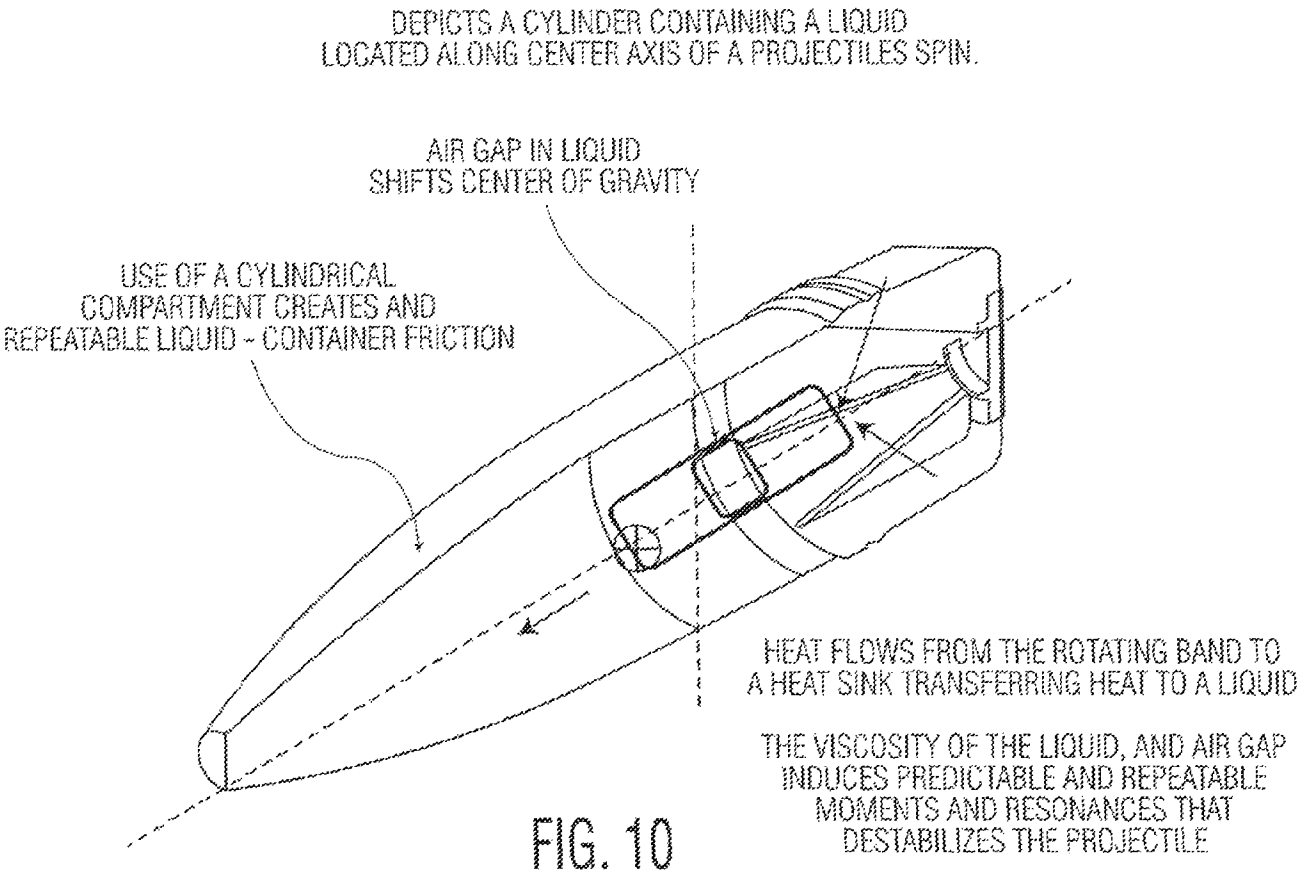
FIG. 10 is a cutaway view of a projectile with a cylindrical void located along the centerline of the axis of rotation.

FIG. 10 depicts a cylindrical cavity along the center of spin of a projectile, illustrating how the driving band is positioned to conduct the flow of heat to cause a change in the material.

Figure 11:
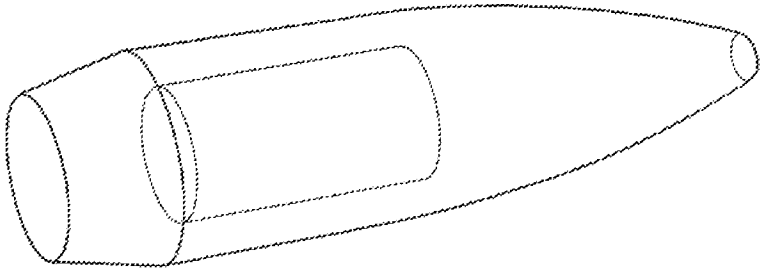
FIG. 11 is a phantom view of a projectile with a cylindrical void geometry.

FIG. 11 depicts a cylindrical cavity in a projectile containing a material of the type used in the present invention.

Figure 12:
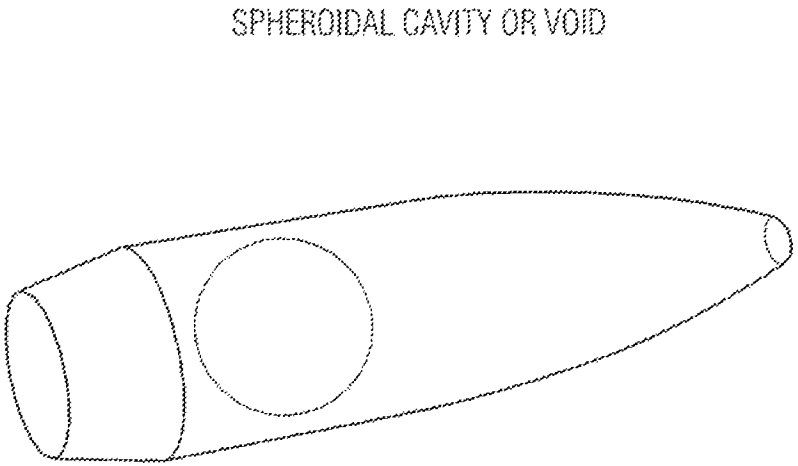
FIG. 12 is a phantom view of a projectile with a spherical void geometry.

FIG. 12 depicts a spheroidal cavity containing a material of the type used in the present invention. A designer using a spheroidal cavity can utilize Greenhill's calculations to induce rapid instability where the frequency of rotation of the projectile corresponds to the natural frequency of the liquid in the void.

Figure 13:
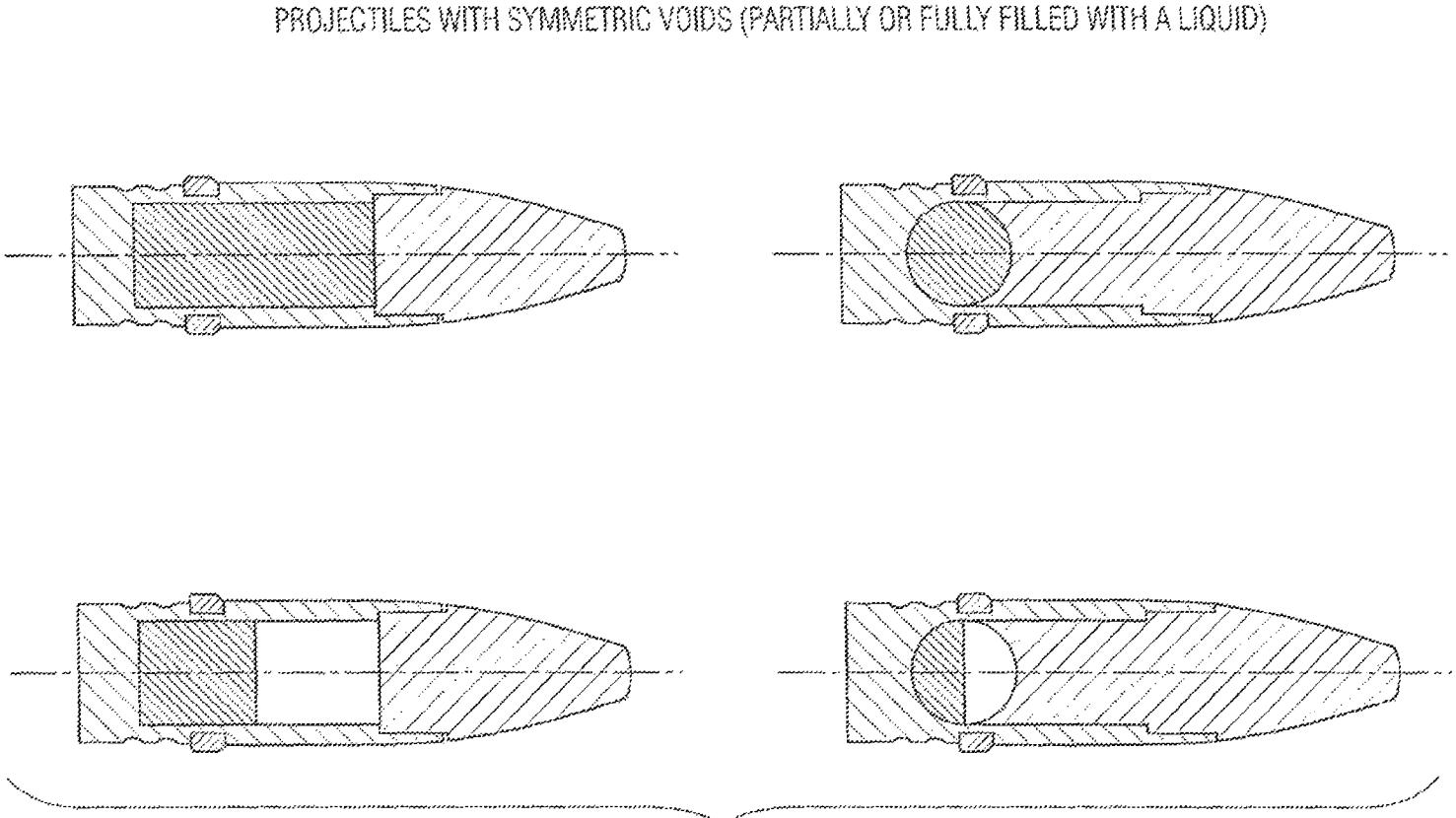
FIG. 13 depicts cross-sectional views of four different projectiles with filled and partially filled voids.
Figure 14:
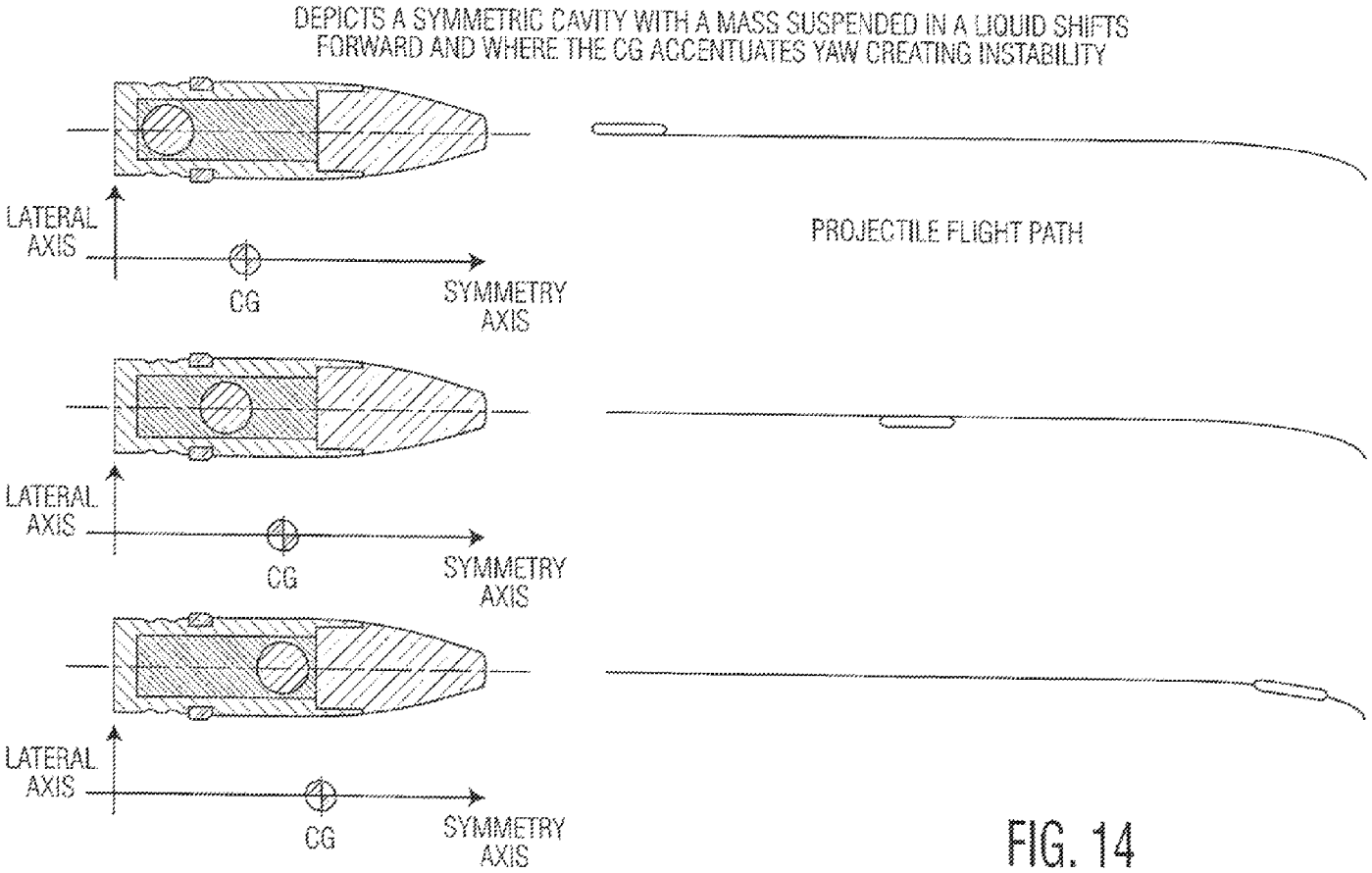
FIG. 14 illustrates a projectile with a symmetric fluid-filled void with a fluid in the void flowing past a sphere as the sphere moves forward, relative to the projectile body. The projectile's flight location along its trajectory is also depicted to the right of each projectile image.
Figure 15:
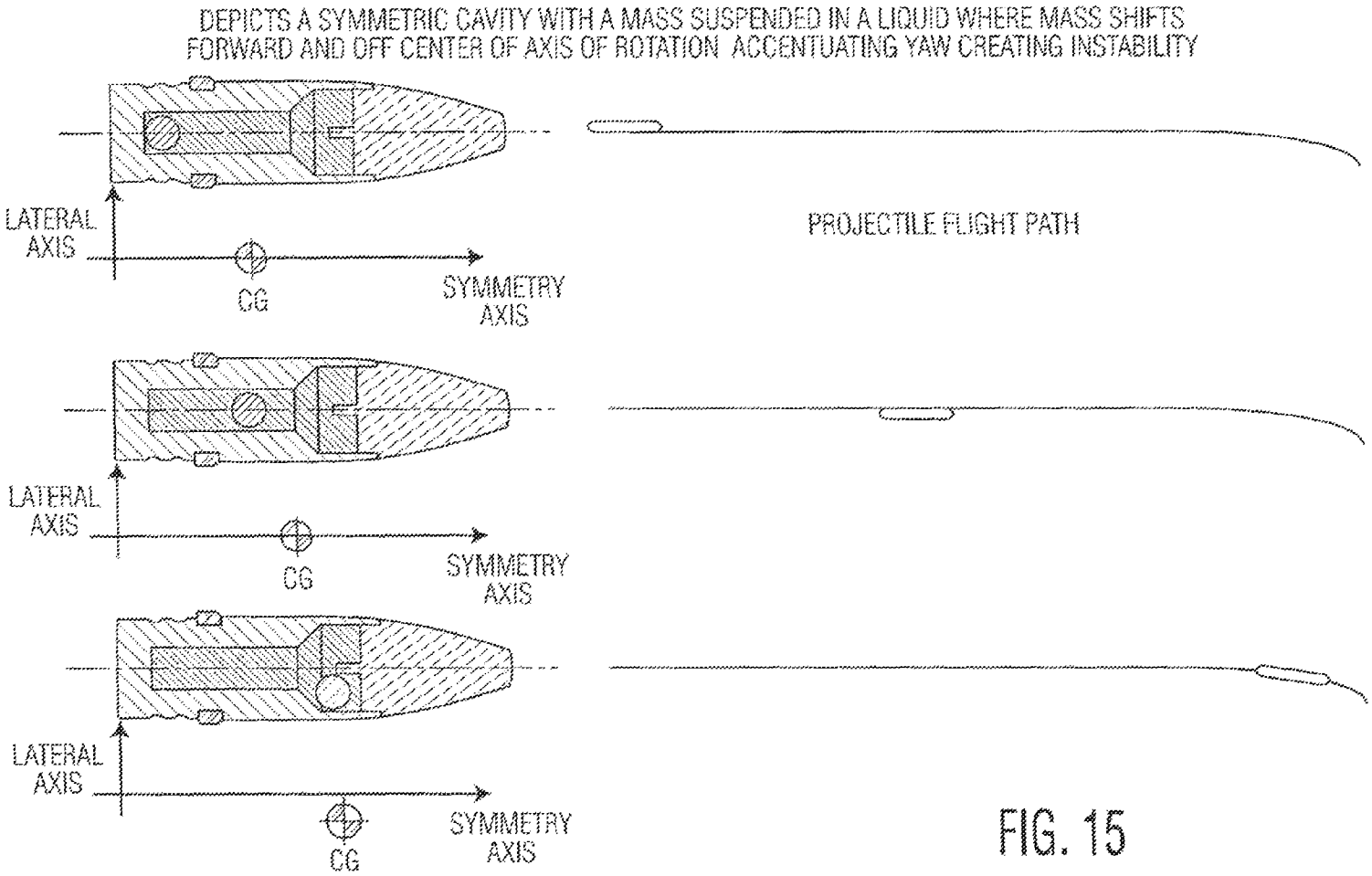
FIG. 15 depicts a projectile with a symmetric void and a solid spherical mass that flows forward in the cavity and moves out of alignment with the axis of rotation. The projectile's flight location along its trajectory is also depicted to the right of each projectile image.
Figure 16:
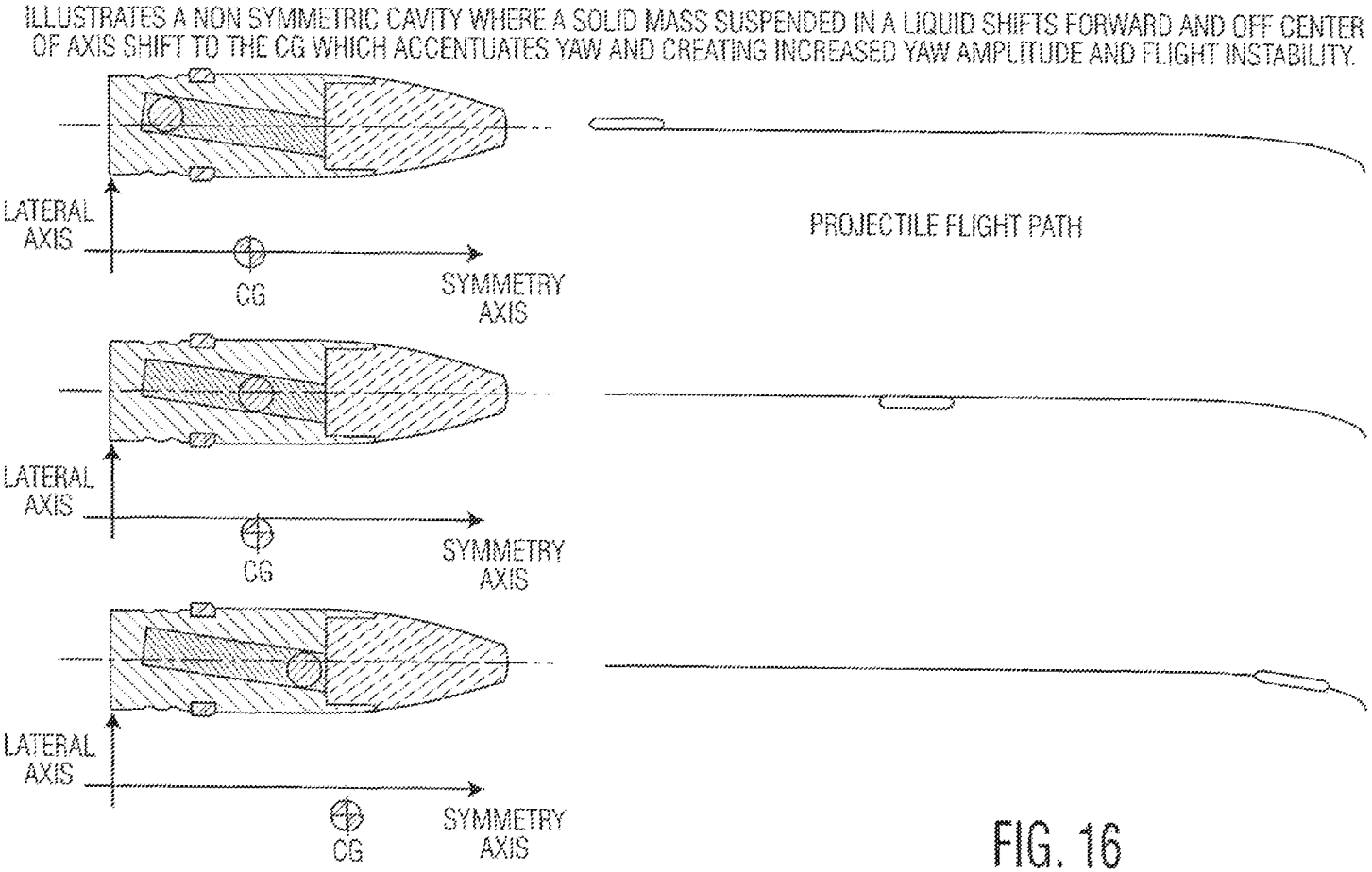
FIG. 16 shows a projectile with a non-symmetric void with a solid mass sphere "off center" from the axis of rotation moving forward and off center in flight. The movement accentuates yaw amplitude. The projectile's flight location along its trajectory is also depicted to the right of each projectile image.
Figure 17:
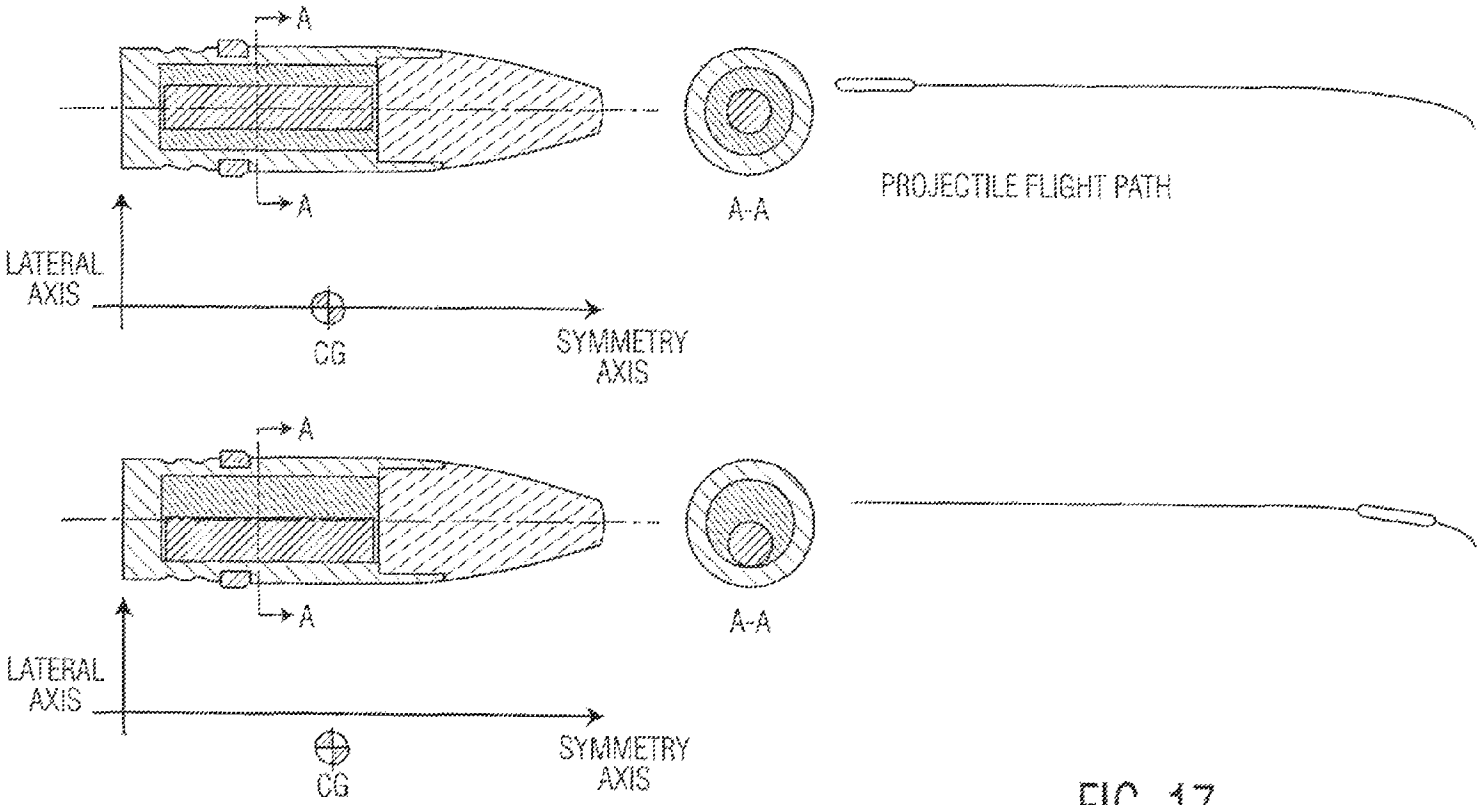
FIG. 17 shows a projectile with a symmetric cylindrical cavity and void suspended in a material that liquefies and shifts during the flight. The shift results in the projectile's center of gravity shifting. The projectile's flight location along its trajectory is also depicted to the right of each projectile image.
Figure 18:
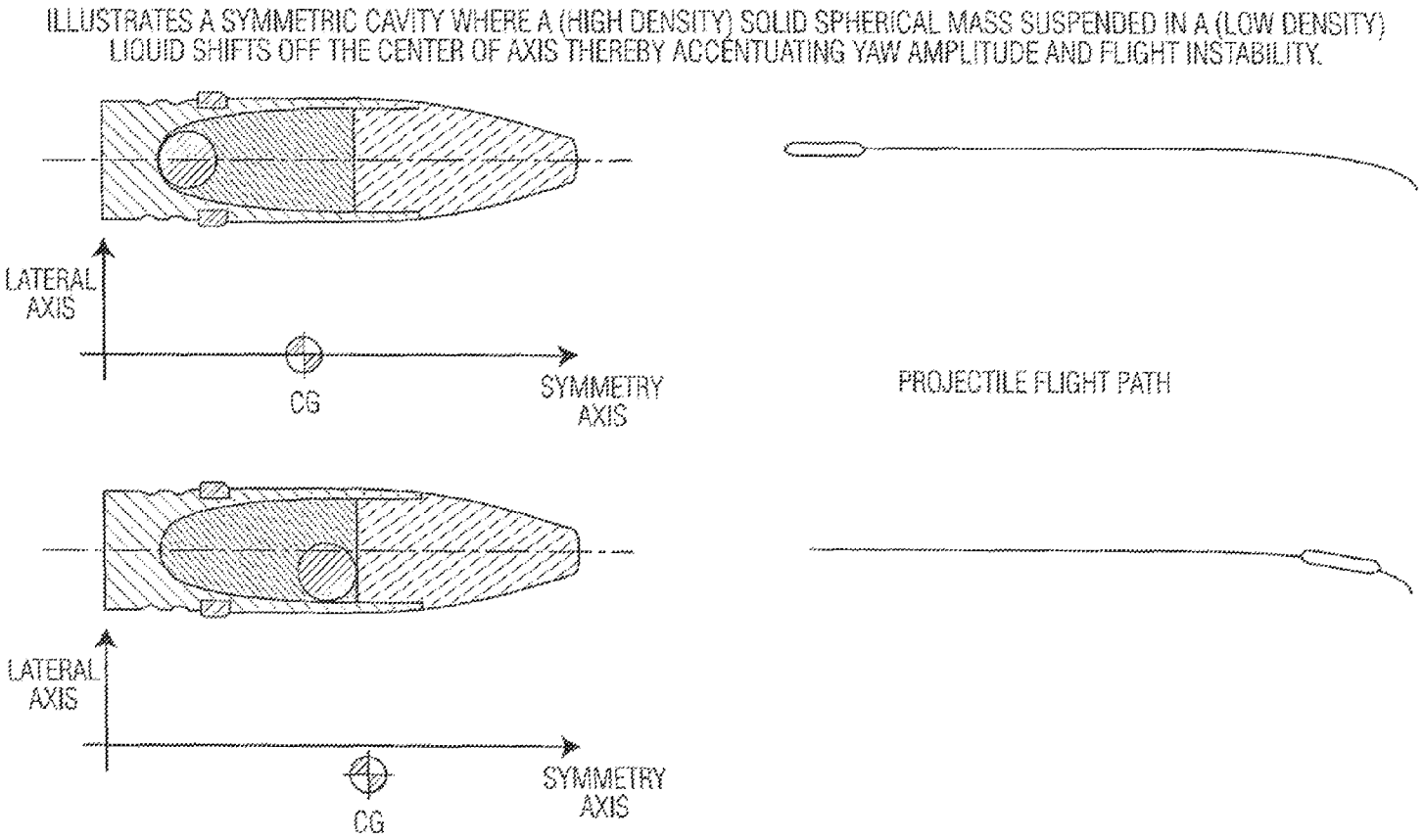
FIG. 18 shows a projectile with a symmetric cavity and a spheroidal mass where a high density spheroid mass is suspended in a low density material that liquefies after muzzle exit, thereby shifting the center of axis, accentuating yaw amplitude and degrading the projectiles flight ballistics. The projectile's flight location along its trajectory is also depicted to the right of each projectile image.

FIG. 13 depicts partially and a fully filled voids in four different projectiles. FIG. 13 depicts a liquid-filled, symmetric void in a projectile in three stages of flight.

FIGS. 14-18 depict projectiles with both symmetric and non-symmetric voids having a solid mass that is released by a phase change in the surrounding material in the void. This material fixes the position of the solid mass at set-back and at successive times during flight, illustrating the solid mass's movement from a location at the center of spin to an offset location. The movement of the mass from the centerline axial position induces increases yaw that destabilizes the projectile's flight.

Figure 19:
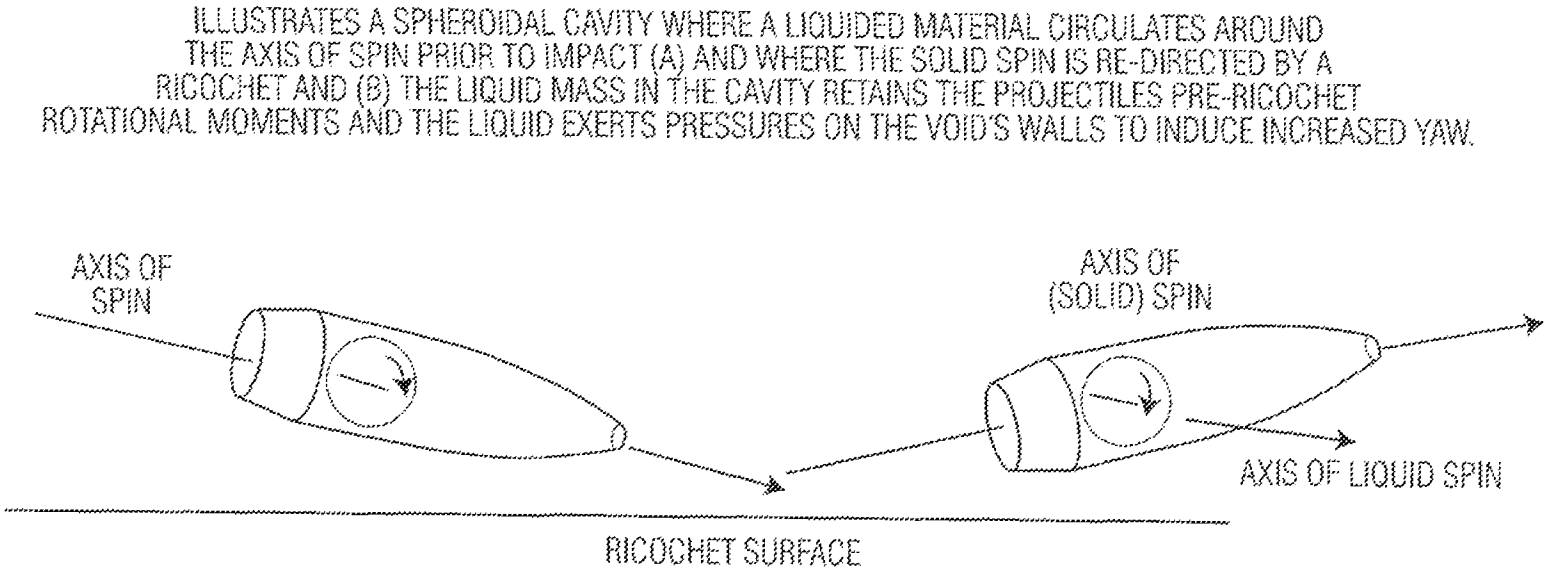
FIG. 19 is diagram showing the effect of a ricochet on a projectile with a liquid-filled void, according to the invention.

FIG. 19 depicts a projectile where the center of rotation of both the liquid and solid are aligned and, upon a ricochet impact, the liquid's axis of spin is no longer aligned with the solid projectile's axis of rotation. The misalignment of the rotational axis induces significant forces on the post ricochet projectile thereby shortening the ricochet danger zone.

The liquid in the projectile void may include a non-Newtonian liquid, and/or a liquid characterized as a Hershel-Buckley, a Bingham and pseudo plastic liquid.

Figure 20:
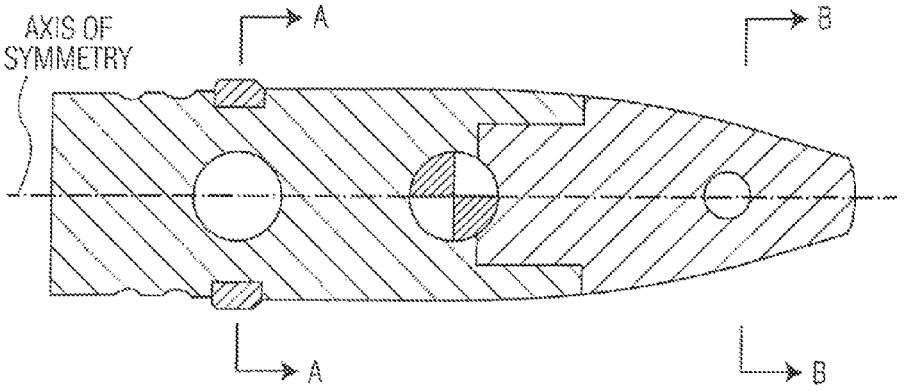
FIG. 20 is a cross-sectional view of a projectile with two cavity voids containing liquids.
Figure 20A:
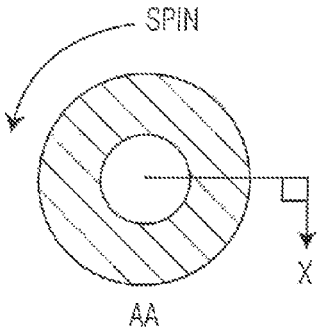
FIG. 20A is a cross-sectional view of the projectile of FIG. 20, taken at line A-A, showing one of the voids.
Figure 20B:
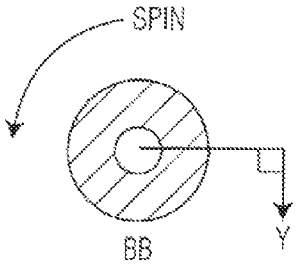
FIG. 20B is a cross-sectional view of the projectile of FIG. 20, taken at line B-B, showing another one of the voids.

FIGS. 20, 20A and 20B show a projectile in flight with two liquid filled voids. The material and void geometries induce different torques X and Y on the projectile where the twisting forces induced increase the projectile conning motion and increased yaw amplitude. Simultaneously the torque slows the projectile's rotation rate.

There has thus been shown and described a novel ammunition cartridge which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention.

What is claimed is:

1. An ammunition cartridge comprising a projectile mounted on a cartridge case with a pyrotechnic propellant, the projectile having a spin-stabilized projectile body with adequate structural integrity to withstand forces of setback and spin that are applied when the projectile is fired from a gun, said projectile body having at least one compartment therein forming a void and containing a material that is a solid at ambient temperatures and that rapidly transitions from a solid phase to a liquid phase after the projectile exits from a barrel of the gun, wherein said material housed in said void transitions from the solid to the liquid phase upon reaching an elevated temperature due, at least in part, to thermal conductive heating from at least one of (1) propellant combustion and (2) external friction applied to the projectile body, whereby the liquid phase of the material progressively induces forces and moments that, after a period of initial stable ballistic flight, produces increasing yaw and flight instability, shortening the projectile's flight.

2. The ammunition cartridge defined in claim 1, wherein the material flows within the void upon transitioning from a solid to a liquid and combined forces of liquid-to-solid friction of the material and imparted resonance induce an increase in the projectile's yaw amplitude, thereby shortening the projectile's maximum range of flight.

3. The ammunition cartridge defined in claim 1, wherein said elevated temperature is above a storage and operational temperature of the ammunition cartridge.

4. The ammunition cartridge defined in claim 1, wherein said elevated temperature is at least about 160° F.

5. The ammunition cartridge defined in claim 1, wherein said projectile body is surrounded by a metal driving band which generates friction heat when the projectile transits through the barrel causing heat to flow through the projectile body to the material in the void.

6. The ammunition defined in claim 1, further comprising a metal heat sink arranged adjacent the void for absorbing heat when the propellant is ignited and the projectile is fired, causing heat to flow to the material in the void.

7. The ammunition defined in claim 1, further comprising a nose that, during high velocity flight, is heated by the friction of air traveling over an outer body of the projectile and where the heat flows to the material in the void.

8. The ammunition cartridge defined in claim 1, wherein said material housed in said void transitions from a solid to a liquid upon exiting the barrel due, in part, to high-g forces applied to the material on set-back and during its accelerated passage through the barrel, and transitions to low g-forces applied during subsequent free flight of the projectile.

9. The ammunition cartridge defined in claim 8, wherein said material is a non-Newtonian fluid.

10. The ammunition cartridge defined in claim 1, wherein said projectile body is made of a frangible material that survives set-back and flight but breaks up upon impact, thereby to preclude a ricochet.

11. The ammunition cartridge defined in claim 1, wherein the projectile material is made of a frangible material that survives set-back and flight but breaks into smaller pieces on impact.

* * * * *